US007914110B2

(12) United States Patent
Curcio et al.

(10) Patent No.: US 7,914,110 B2
(45) Date of Patent: Mar. 29, 2011

(54) PURGING FLUID FROM FLUID-EJECTION NOZZLES BY PERFORMING SPIT-WIPE OPERATIONS

(75) Inventors: Brian E. Curcio, San Diego, CA (US); Jeffrey Anderson, Singapore (SG); Cynthia Jarom, San Diego, CA (US); Jeffrey D. Rutland, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 920 days.

(21) Appl. No.: 11/669,585

(22) Filed: Jan. 31, 2007

(65) Prior Publication Data

US 2009/0073219 A1 Mar. 19, 2009

(51) Int. Cl.
*B41J 2/165* (2006.01)

(52) U.S. Cl. ..... 347/33; 347/32; 347/35

(58) Field of Classification Search ..... 347/29, 347/33–36

See application file for complete search history.

(56) References Cited

U.S. PATENT DOCUMENTS

| | | | | |
|---|---|---|---|---|
| 6,000,780 | A * | 12/1999 | Schwiebert et al. | 347/33 |
| 6,752,493 | B2 * | 6/2004 | Dowell et al. | 347/89 |
| 6,896,350 | B2 * | 5/2005 | Gomez et al. | 347/23 |
| 7,334,859 | B2 * | 2/2008 | Kojima | 347/19 |

* cited by examiner

*Primary Examiner* — Julian D Huffman
*Assistant Examiner* — Jason S Uhlenhake

(57) ABSTRACT

Fluid is purged from a plurality of fluid-ejection nozzles of a fluid-ejection mechanism. A first series of spit-wipe operations is performed. A second series of spit-wipe operations is then performed.

20 Claims, 9 Drawing Sheets

PURGING FLUID FROM FLUID-EJECTION NOZZLES BY PERFORMING SPIT-WIPE OPERATIONS

BACKGROUND

A common way to form images on media, such as paper, is to use a fluid-ejection device, such as an inkjet-printing device. An inkjet-printing device has a number of inkjet nozzles that eject ink, such as differently colored ink, in such a way as to form a desired image on the media. Many inks are dye-based, whereas other inks are pigment-based. In some formulations, these inks may be or may become relatively viscous.

Such viscous inks can form viscous sludge inside the inkjet nozzles. This sludge can affect typical testing, such as single drop detect testing, to determine whether the inkjet nozzles properly eject the ink. For instance, the performance of a single drop detect test may result in an inkjet nozzle using a pigment-based ink being seemingly OK to properly eject ink, only to fail to eject ink thereafter.

When an inkjet nozzle has failed a test to determine whether it is properly ejecting ink, generally the nozzles undergo servicing so that they can indeed properly eject ink. Typically, the nozzles undergo servicing such that a least-severe servicing event is performed first. The least-severe servicing event causes less ink to be ejected than more-severe servicing events. However, this conventional approach of servicing can greatly lengthen the time it takes to service an inkjet nozzle for pigment-based inks.

So-called "spitting," or ejecting, of ink from an inkjet nozzle has been found to be an efficient way to remove large volumes of ink from an inkjet mechanism, such as an inkjet printhead, including the nozzle, when needed. However, in the case of pigment-based inks, such spitting can result in viscous sludge forming on the inkjet mechanism. This conventional ink spitting is thus disadvantageous as well.

DETAILED DESCRIPTION OF THE DRAWINGS

Representative Fluid-Ejection Device

Figure 1:
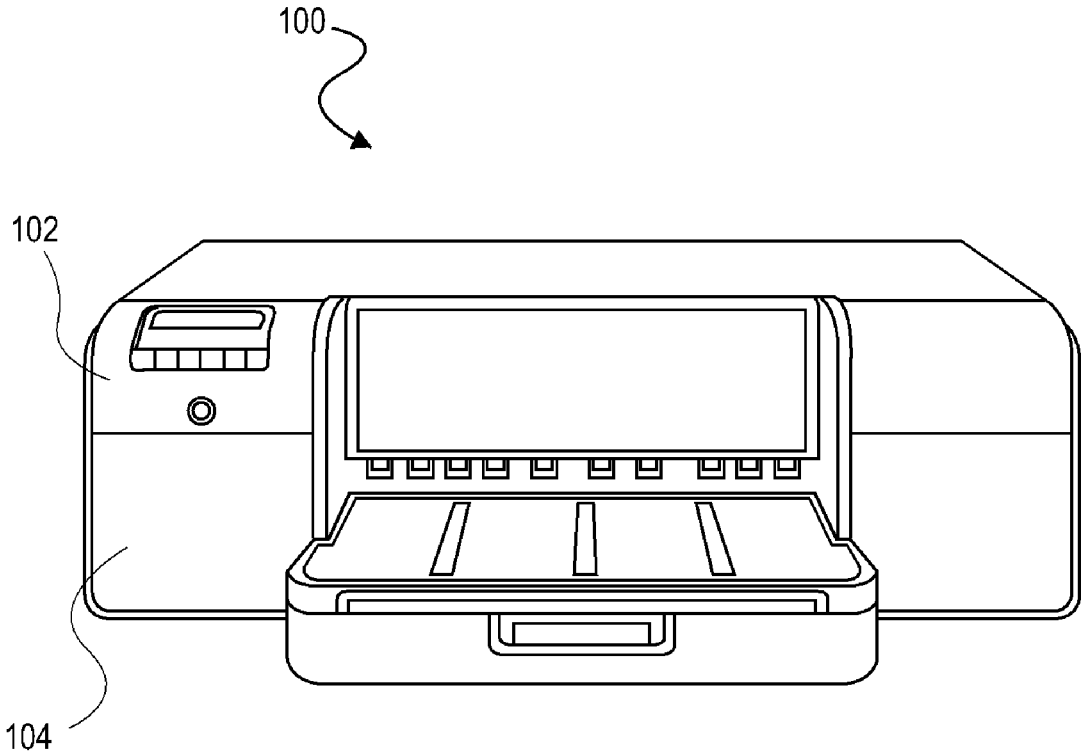
FIG. 1 is a diagram of a representative inkjet-printing device, according to an embodiment of the invention.

FIG. 1 shows a representative inkjet-printing device 100, according to an embodiment of the invention. The inkjet-printing device 100 is a device, such as a printer, that ejects ink onto media, such as paper, to form images, which can include text, on the media. The inkjet-printing device 100 is more generally a fluid-ejection device that ejects fluid, such as ink.

The inkjet-printing device 100 may eject pigment-based ink, dye-based ink, or another type of ink. The inkjet-printing device 100 includes at least two access doors: an access door 102, and an access door 104. The access door 104 is opened to permit a user to remove and insert ink cartridges into and from the inkjet printing device 100. The access door 102 is opened to permit a user to remove and insert inkjet printheads into and from the inkjet printing device 100.

Figure 2A:
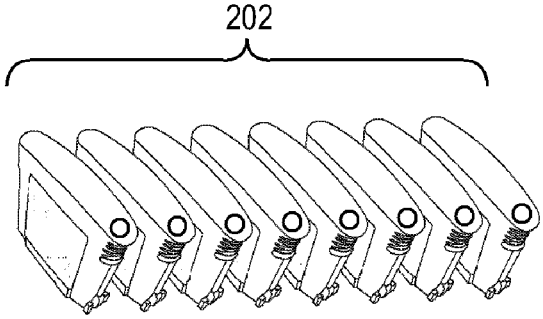
FIGS. 2A and 2B are diagrams of inkjet cartridges and how they are inserted into an inkjet-printing device, according to an embodiment of the invention.

FIG. 2A shows a number of ink cartridges 202 that may be inserted into the inkjet-printing device 100, according to an embodiment of the invention. In one embodiment, there may be eight such ink cartridges 202. These ink cartridges 202 may include photo black pigment-based ink cartridge, a light gray pigment-based ink cartridge, and a matte black pigment-based ink cartridge. These ink cartridges 202 may further include a cyan pigment-based ink cartridge, a magenta pigment-based ink cartridge, a yellow pigment-based ink cartridge, a light magenta pigment-based ink cartridge, and a light cyan pigment-based ink cartridge. Having eight such ink cartridges 202 enables the inkjet-printing device 100 to print photorealistic full-color images on media.

In another embodiment, however, there may be just four ink cartridges 202. The ink cartridges 202 in this embodiment may include black, cyan, magenta, and yellow ink cartridges. Having four such ink cartridges enables the inkjet-printing device 100 to print full-color images on media, but generally not as photorealistic as when there are eight ink cartridges 202. In still another embodiment, there may be just a single black ink cartridge 202. In this embodiment, the inkjet-printing device 100 can print black-and-white and grayscale images on media, but not color images.

Figure 2B:
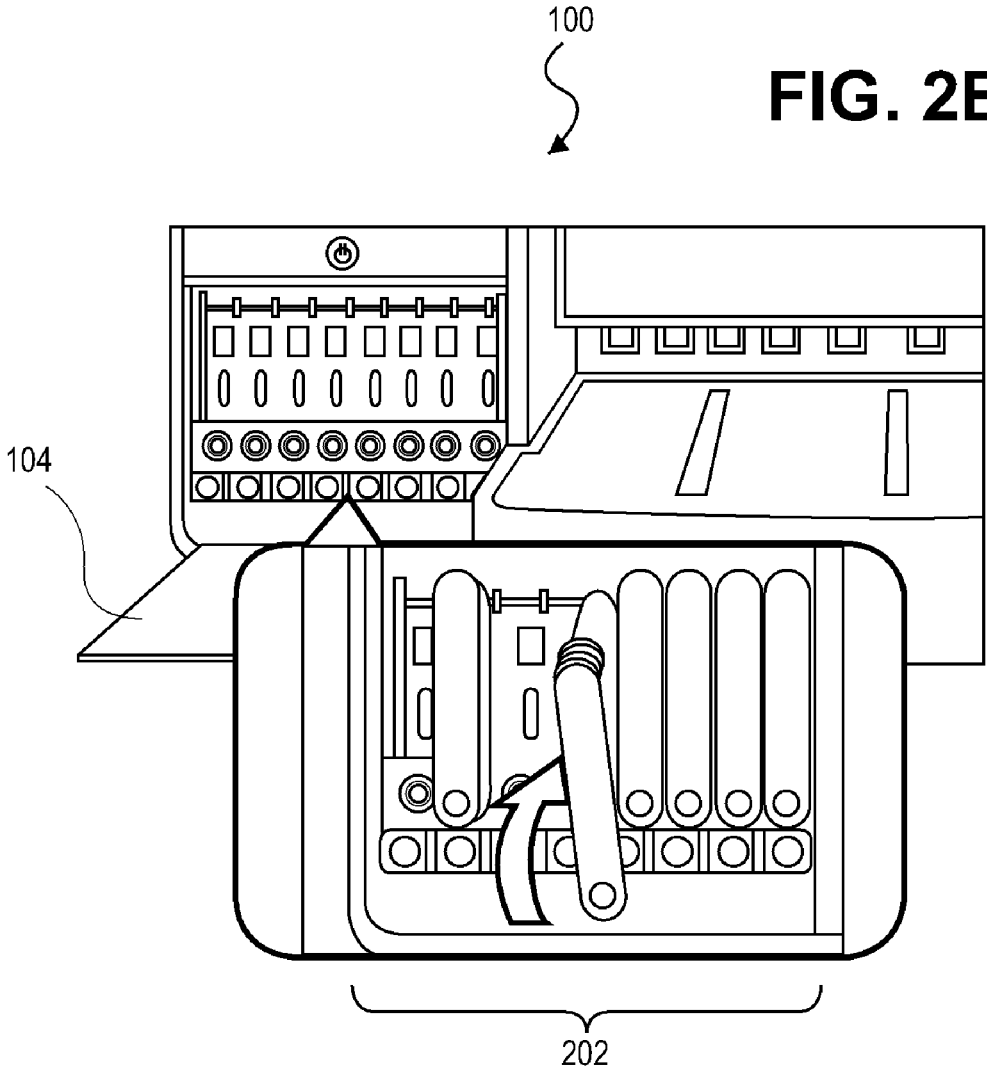

FIG. 2B shows how the ink cartridges 202 may be inserted into the inkjet-printing device 100, according to an embodiment of the invention. The access door 104 is opened downwards. Opening the access door 104 reveals a number of slots. The ink cartridges 202 can be inserted into and removed from these slots of the inkjet-printing device 100. The ink cartridges 202 supply the differently colored ink by which the inkjet-printing device 100 forms images on media. The inkjet cartridges 202 are more generally fluid supplies, such as supplies of ink.

Figure 3A:
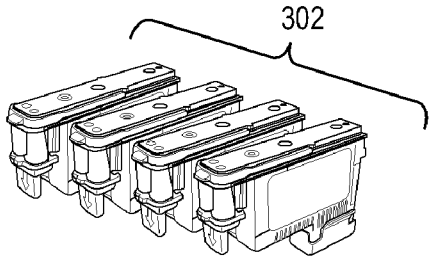
FIGS. 3A and 3B are diagrams of inkjet printheads and how they are inserted into an inkjet-printing device, according to an embodiment of the invention.

FIG. 3A shows a number of inkjet printheads 302 that may be inserted into the inkjet-printing device 100, according to an embodiment of the invention. The inkjet printheads 302 are more generally fluid-ejection mechanisms, in that they are the actual mechanisms that eject fluid, such as ink, onto media to form images on the media. There may be four such inkjet printheads 302 in one embodiment of the invention. One inkjet printhead may be responsible for ejecting photo black and light gray ink. Another inkjet printhead may be responsible for ejecting matte black and cyan ink. A third inkjet printhead may be responsible for ejecting magenta and yellow ink. The last inkjet printhead may be responsible for ejecting light magenta and light cyan ink.

In another embodiment, however, there may be just two inkjet printheads 302, in the case where there are just four differently colored inks, cyan, magenta, yellow, and black. One of these inkjet printheads may be responsible for ejecting black ink, whereas the other printhead may be responsible for ejecting cyan, magenta, and yellow ink. In still another embodiment, there may be just a single inkjet printhead, in the case where there is just black ink, such that the single inkjet printhead ejects this black ink.

Figure 3B:
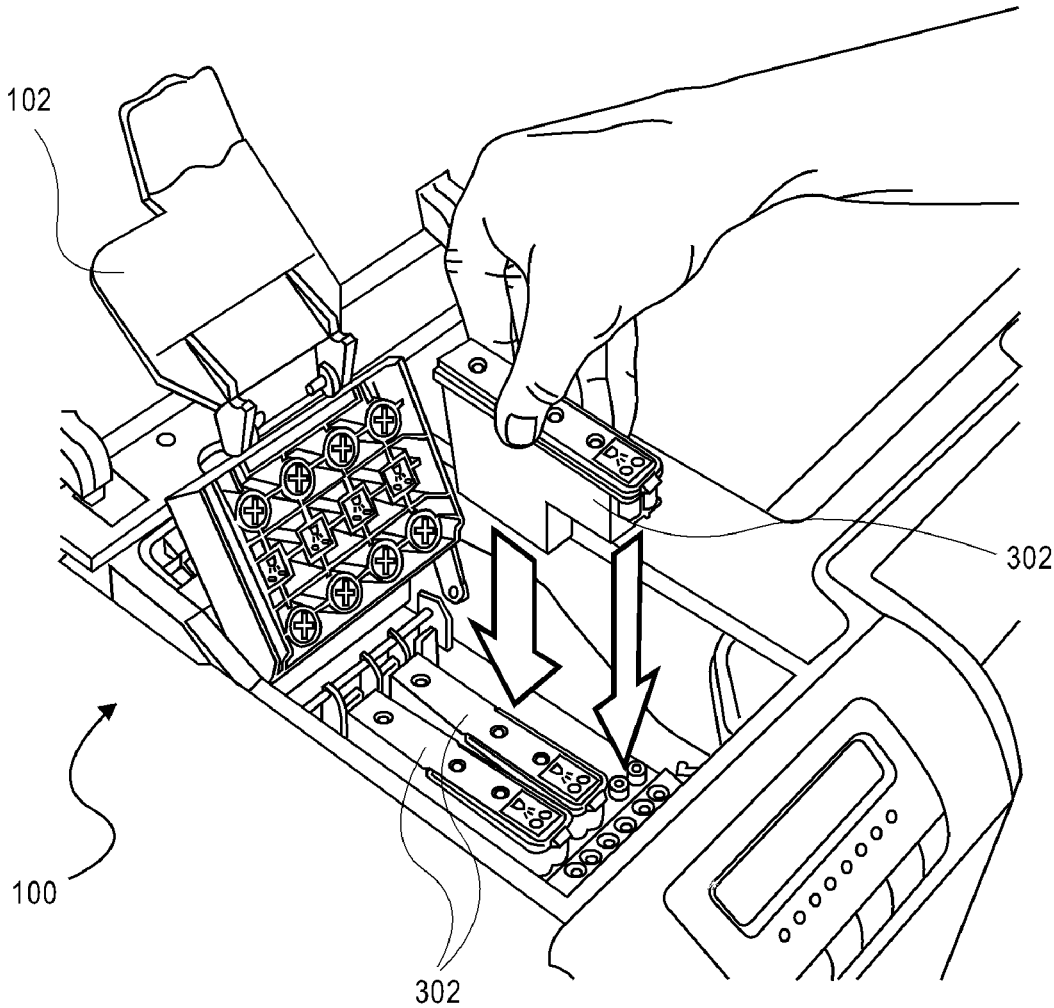

FIG. 3B shows how the inkjet printheads 302 may be inserted into the inkjet-printing device 100, according to an embodiment of the invention. The access door 102 is opened upwards. Opening the access door 102 reveals a number of slots. The inkjet printheads 302 can be inserted into and removed from these slots of the inkjet-printing device 100. The inkjet printheads 302 thus eject the ink supplied by the ink cartridges 202 to form images on media.

The embodiments of the invention that have been described in relation to FIGS. 2A, 2B, 3A, and 3B employ ink supplies—the ink cartridges 202—that are separate from the inkjet printheads 302. However, in another embodiment, the inkjet cartridges 202 may be integrated within the inkjet printheads 302. That is, the inkjet printheads 302 may themselves include supplies of ink, such that there are no separate inkjet cartridges 202 per se to be inserted into and removed from the inkjet-printing device 100.

Figure 4:
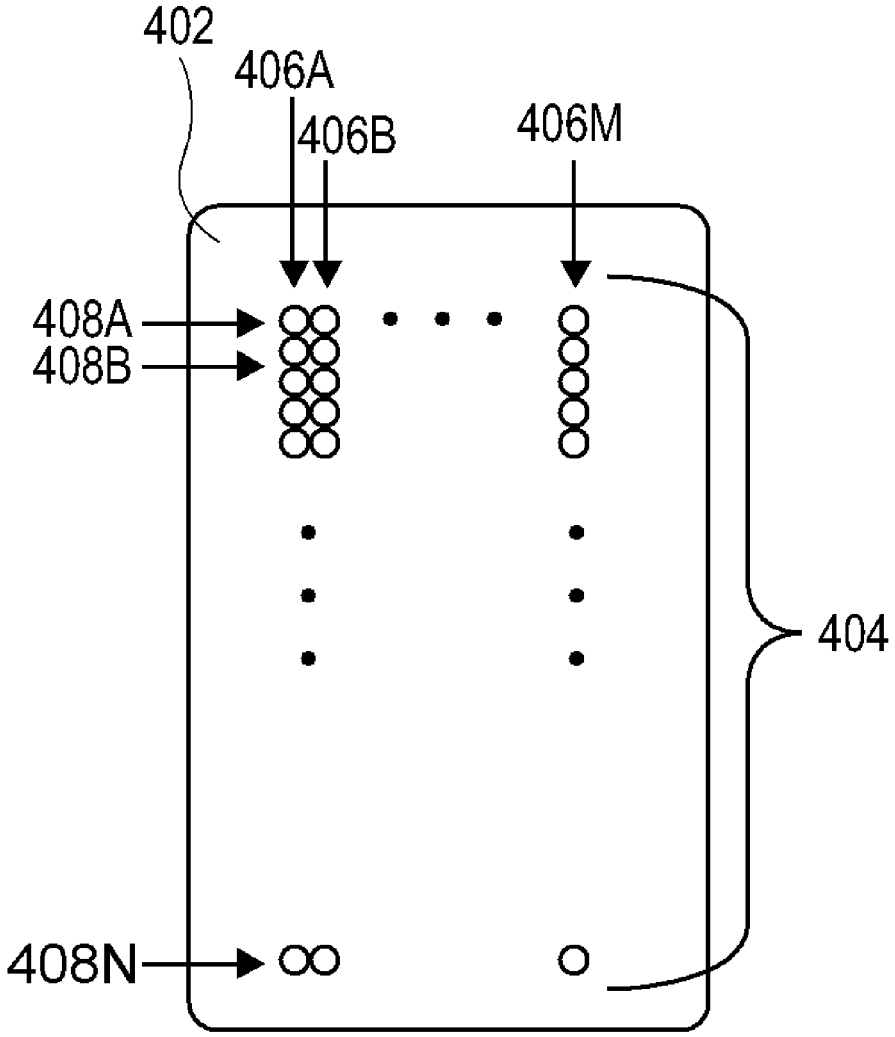
FIG. 4 is a diagram of an inkjet printhead having a number of inkjet nozzles, according to an embodiment of the invention.

FIG. 4 shows a detailed view of an inkjet printhead 402, according to an embodiment of the invention. The inkjet printhead 402 exemplifies each of the inkjet printheads 302 that have been described. The side of the inkjet printhead 402 from which ink is actually ejected is specifically depicted in FIG. 4.

The inkjet printhead 402 includes a number of inkjet nozzles 404, which may more generally be referred to as fluid-ejection nozzles. The inkjet nozzles 404 are organized over a number of columns 406A, 406B, . . . , 406M, collectively referred to as the columns 406, and a number of rows 408A, 408B, . . . , 408N, collectively referred to as the rows 408. In one embodiment, for example, there may be four columns 406 and 528 rows 408, for a total of 2,112 of inkjet nozzles 404. It is noted that the inkjet nozzles 404 are organized in aligned columns 406 in the example of FIG. 4. However, in another embodiment, the inkjet nozzles 404 may be organized in columns 406 such that adjacent columns are staggered relative to one another.

The inkjet nozzles 404 are the orifices from which ink, or fluid, is ejected out of the inkjet printhead 402. The surface of the inkjet printhead 402 shown in FIG. 4 may be referred to as the orifice plate, which comes into close contact with the media so that ink can be precisely ejected from the inkjet nozzles 404 onto the media in a desired manner. The inkjet nozzles 404, especially in the case where the ink is a pigment-based ink, are susceptible to clogging, however.

That is, as described in the background section, pigment-based ink can form sludge on the orifice plate and/or on or within the inkjet nozzles 404, impeding the ability of the inkjet nozzles 404 to properly eject ink onto the media to form desired images on the media, where such images may also include text in addition to graphics. Embodiments of the invention are thus concerned with detecting whether the inkjet nozzles 404 of the inkjet printhead 402 are able to properly eject ink. Embodiments of the invention are further concerned with detecting whether servicing the inkjet nozzles 404 of the inkjet printhead 402 when they are unable to properly eject ink.

Servicing Process

Figure 5A:
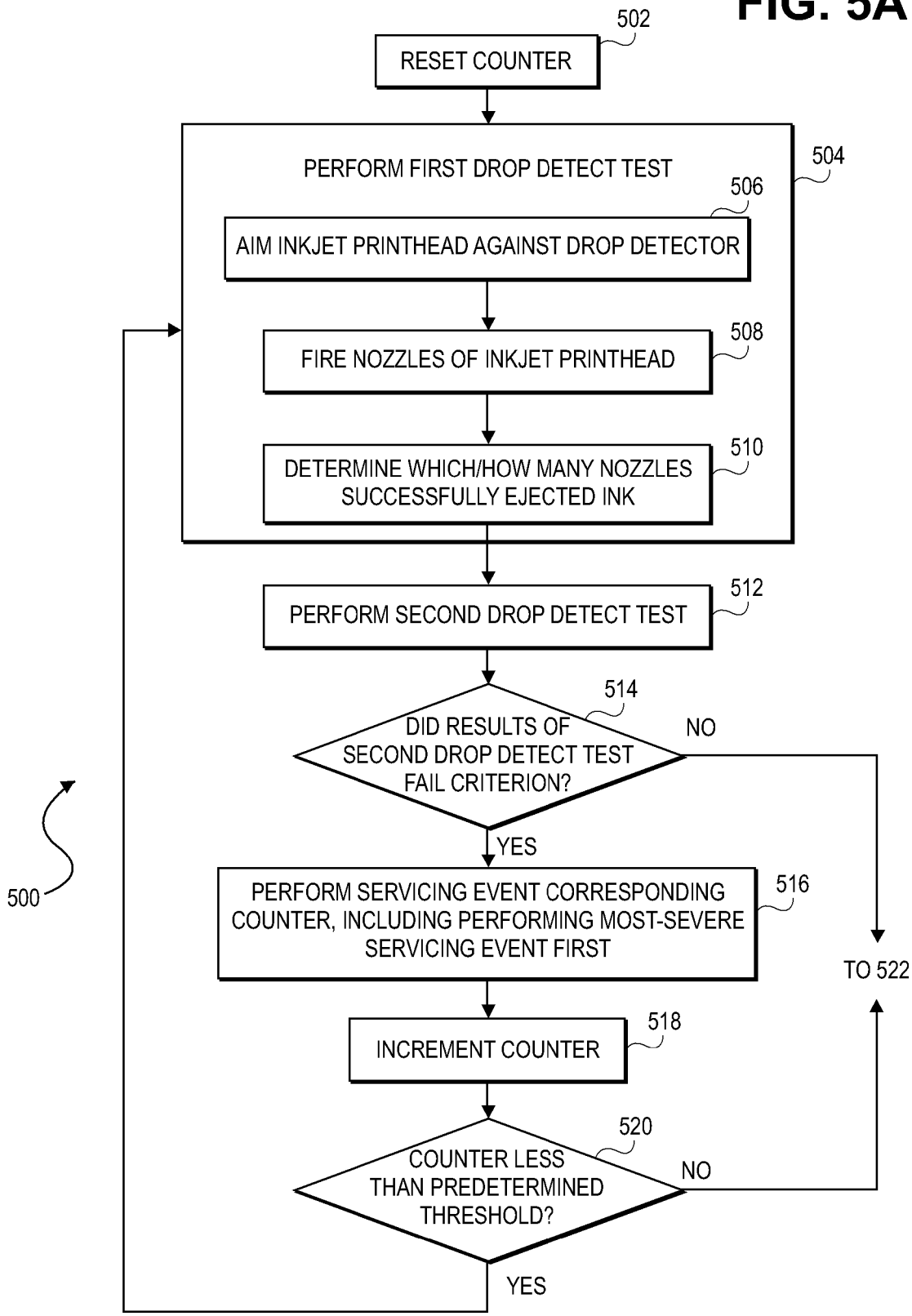
FIGS. 5A, 5B, and 5C are flowcharts of a method for servicing an inkjet printhead, according to an embodiment of the invention.
Figure 5B:
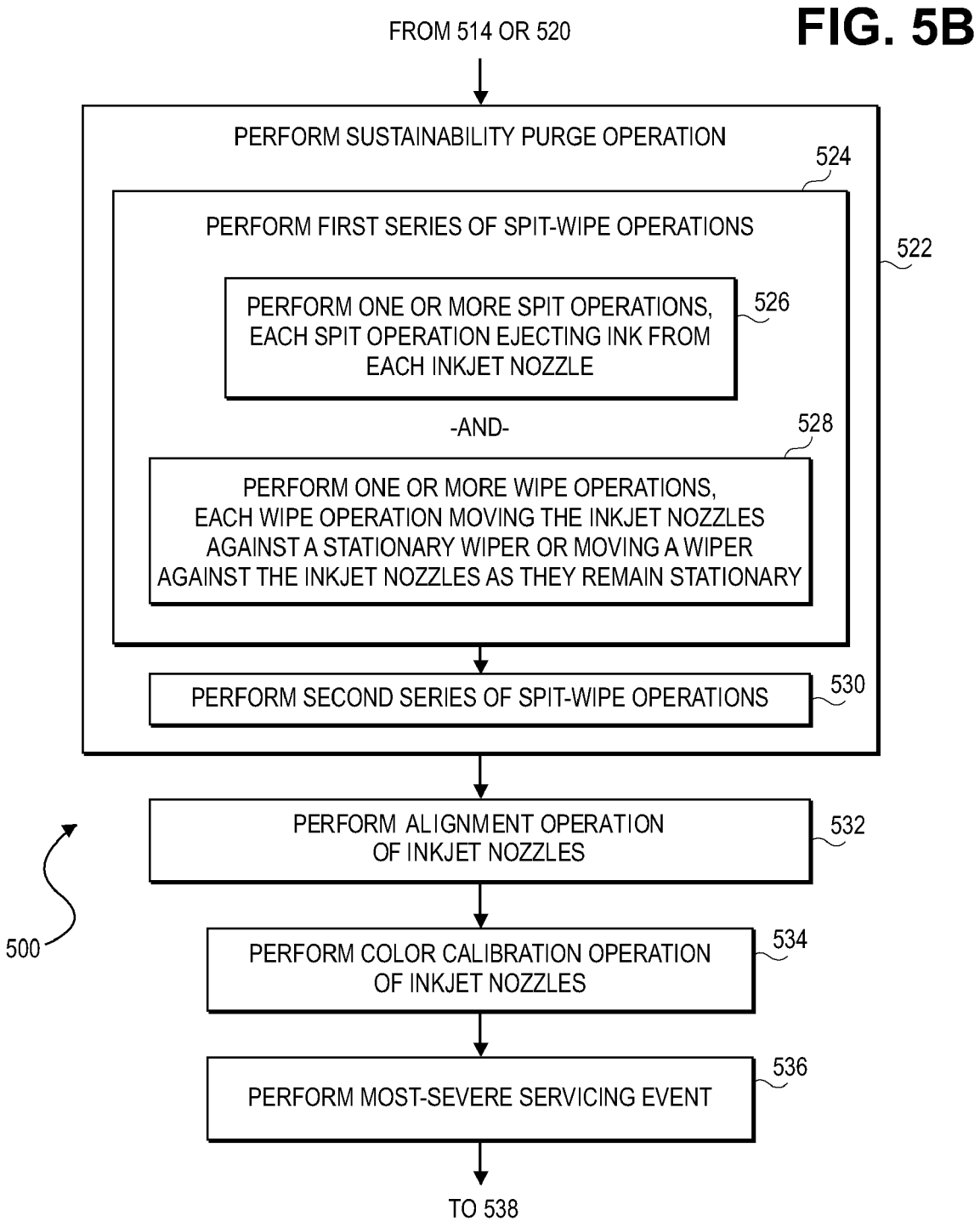
Figure 5C:
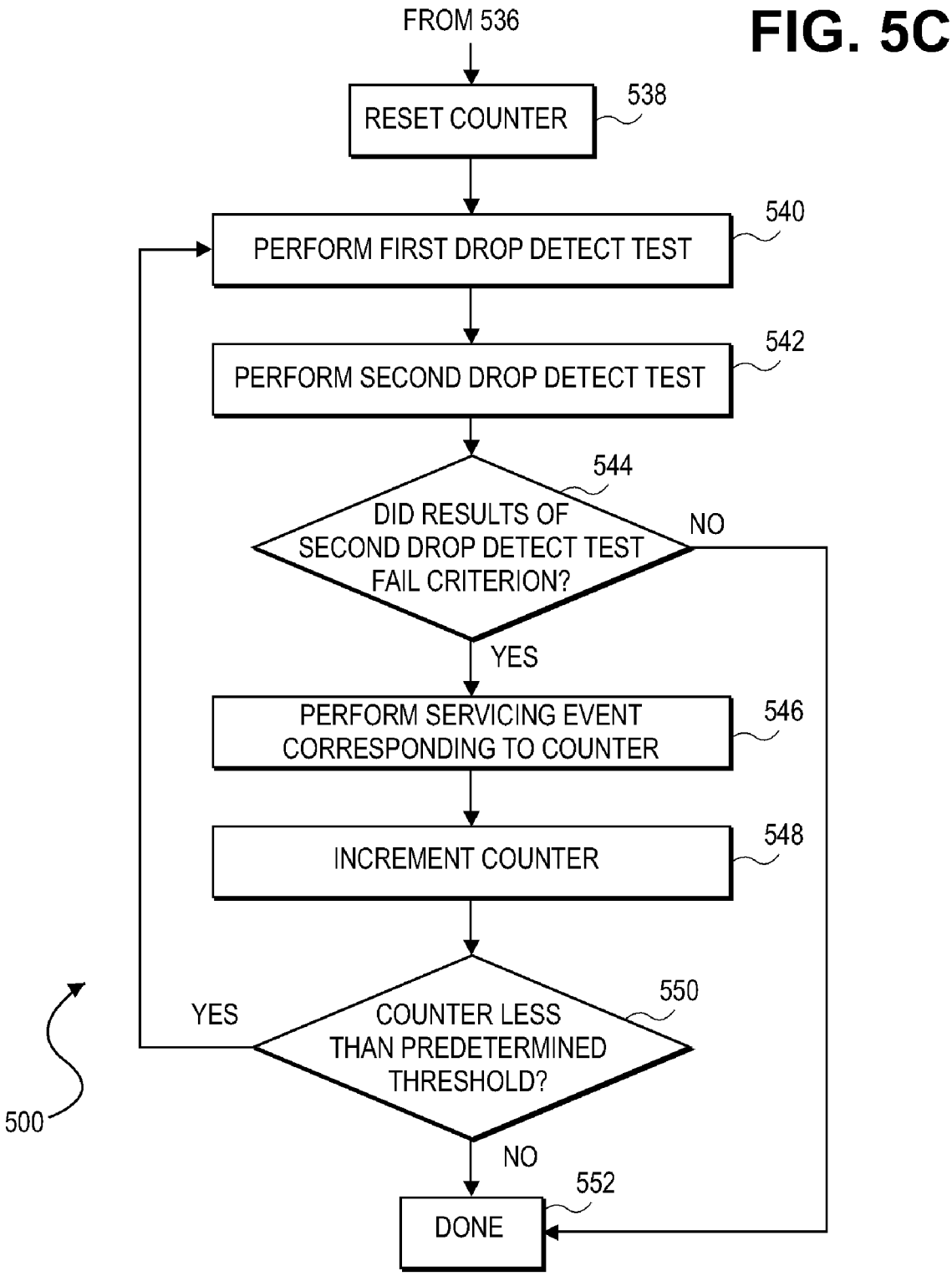

FIGS. 5A, 5B, and 5C show a method 500 for servicing the inkjet printhead 402 of the inkjet-printing device 100, according to an embodiment of the invention. The method 500 may be performed when the inkjet printhead 402 has been newly installed within the inkjet-printing device 100. The method 500 may further be performed at periodic cleaning or servicing intervals, or may be initiated by the user when printing quality has degraded.

Referring first to FIG. 5A, a counter is reset to zero (502). Thereafter, a first drop detect test is performed (504). A drop detect test determines which and how many of the inkjet nozzles 404 of the inkjet printhead 402 are properly ejecting ink, as opposed to, for instance, being clogged. Drop detect tests include electrostatic drop detect tests and optical drop detect tests, among other types of drop detect tests. An electrostatic drop detect test detects the charge of an ink drop that is induced upon the ink drop by an electrostatic drop detect target. The amount of charge that is detected is related to the amount of ink that is deposited on the target. By comparison, an optical drop detect test optically determines whether and how much ink has been deposited on a target.

Thus, the first drop detect test can be performed in one embodiment as follows. First, the inkjet printhead 402 is moved so that it is aimed against a drop detector (506), which is another term for a drop detect target. The inkjet nozzles 404 of the inkjet printhead 402 are then fired (508). Based on where and how much ink is deposited on the drop detect target, it can be determined which and how many of the inkjet nozzles 404 successfully (and actually) ejected ink (510).

Figure 6:
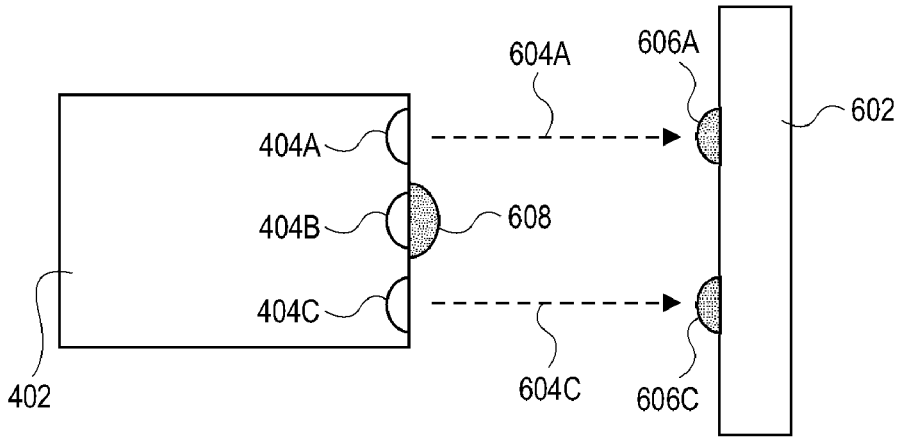
FIG. 6 is a diagram depicting a representative drop detect test, according to an embodiment of the invention.

FIG. 6 illustratively shows a drop detect test, according to an embodiment of the invention. Just three inkjet nozzles 404A, 404B, and 404C of the inkjet printhead 402 are depicted in FIG. 6 for illustrative convenience. The inkjet printhead 402 is aimed against a drop detector 602, which may also be referred to as a drop detect target. The inkjet nozzles 404A, 404B, and 404C are then fired to cause them to eject ink.

As indicated by the arrows 604A and 604C, the inkjet nozzles 404A and 404C ejected ink 606A and 606C, respectively, against the drop detector 602. The drop detector 602 is able to detect this ink 606A and 606C, and correspond the ink 606A and 606C to the inkjet nozzles 404A and 404C, so that it can be concluded that the inkjet nozzles 404A and 404C properly ejected ink. By comparison, however, dried ink 608, or sludge, has formed over the inkjet nozzle 404B. As a result, the inkjet nozzle 404B did not successfully and properly eject ink, such that the drop detector 602 did not detect any ink being deposited thereon as a result of the inkjet nozzle 404B firing.

Referring back to FIG. 5A, after the first drop detect test is performed, a second drop detect test is performed (512). The second drop detect test may be performed in the same manner in which the first drop detect test has been performed, as has been described. More generally, more than one drop detect test is performed. The method 500 determines whether the results of the second drop detect test in the embodiment of FIG. 5A has failed a criterion (514). More generally, the method 500 determines whether the results of the last drop detect test has failed the criterion. Thus, in the embodiment of FIG. 5A, the results of the first drop detect test are discounted and not used or compared against a criterion, and just the results of the second drop detect test are used. More generally, just the results of the last drop detect test are used and compared against the criterion.

It has been found, for instance, that where a single drop detect test is performed and indicates that the inkjet nozzles of an inkjet printhead are properly ejecting ink, the inkjet printhead may nevertheless may have residual clogs or sludge that did not prevent the single drop detect test from succeeding, but that will soon affect ink ejection by the nozzles. Therefore, this is why two drop detect tests are performed in the embodiment of FIG. 5A. More generally, it has been found that where more than one drop detect test is performed, the results of the last drop detect test more accurately reflect whether the inkjet nozzles of the inkjet printhead are properly ejecting ink, and are not affected by any residual clogs or sludge that would otherwise soon affect ink ejection.

It is noted that performing more than one drop detect test does not have to be performed for all colors of ink. Rather, just one drop detect test may be performed for some of the differently colored inks, and more than one drop detect may be performed for other of the differently colored inks. In one embodiment, for instance, more than one drop detect test is performed just for matte black ink. Empirical testing can be performed, as can be appreciated by those of ordinary skill within the art, to determine whether one or more than one drop detect test should be performed for a given color of ink.

In one embodiment, the criterion against which the results of the second (i.e., last) drop detect test are compared is a number of the inkjet nozzles 404 of the inkjet printhead 402 that did not successfully eject ink, as detected by the drop detect target. For instance, this criterion may be twenty nozzles. If more than twenty nozzles did not eject ink during the drop detect test, then the drop detect test is considered as having failed the criterion. If twenty or less nozzles did not eject ink during the drop detect test, then the drop detect test is considered as having passed the criterion, by comparison.

Assuming that the results of the second drop detect test in the embodiment of FIG. 5A failed the criterion (514), then a servicing event is performed (516) in order to clear the clogged or sludged-over nozzles. A different servicing event is performed based on the current value of the counter. In particular, however, the servicing event that is performed first (i.e., corresponding to a counter value of zero) is a most-severe servicing event. Servicing event severity can denote the amount of ink that is removed from an inkjet nozzle. Thus, a more severe servicing event is one that removes more ink than a less severe servicing event.

The severity of a servicing event is thus dependent on which operations are performed as part of the servicing event. For example, as will be described in more detail, a servicing event can include one or more spit operations, one or more wipe operations, and/or one or more prime operations designed to unclog any clogged of the inkjet nozzles 404 of the inkjet printhead 402. A spit operation is specifically an operation in which a predetermined amount of ink is ejected from an inkjet nozzle. The inkjet nozzle may be fired a number of times at high frequency to eject this predetermined amount of ink. A wipe operation is an operation in which a wiper is moved in relation to the inkjet nozzle, to clean any ink on or around the nozzle. A prime operation is specifically an operation in which ink is removed from an inkjet nozzle by using suction. Examples of spit and wipe operations are described in more detail later in the detailed description. The amount of ink removed from an inkjet nozzle by all the various operations of a given servicing event in total thus is indicative of the severity of this servicing event.

In one embodiment, one of three servicing events, corresponding to counter values of zero, one, and two, is performed in part 516 of the method 500. As has been noted, the first servicing event is most severe, and may include performing heavy prime, light prime, spit, and wipe operations. The second servicing event is less severe, and may include performing heavy prime, spit, and wipe operations. The third servicing event is least severe, and may include performing light prime, spit, and wipe operations.

It is noted that performing the most-severe servicing event first is unlike the prior art, and indeed is somewhat counter-intuitive. Conventionally, the least-severe servicing event is performed first, and any other servicing events are performed in order in increasing degrees of severity, such that the most-severe servicing event is performed last. The motivation behind doing so is to decrease servicing time, insofar as the greater the severity of a servicing event, the longer it takes to perform the servicing event.

However, what has been found is that with pigment-based inks in particular, the least-severe servicing event either does not usually clear the clogged inkjet nozzles for at least certain colors of ink such as matte black ink, and/or clears the clogged inkjet nozzles but not enough to prevent image formation degradation from occurring soon thereafter. Therefore, performing the most-severe servicing event first is accomplished so that image formation degradation does not occur soon after servicing is performed, and to ensure that the clogged inkjet nozzles are more likely to be cleared the first time a servicing event is performed. This will become more apparent as the remainder of FIG. 5A is described.

Once the servicing event has been performed, the counter is incremented (518). The counter is then compared against a predetermined threshold (520). In one embodiment, this threshold is three. Thus, if the value of the counter is less than three, then the method 500 repeats at part 504. Otherwise, once the value of the counter has reached three, then the method 500 proceeds to part 522 in FIG. 5B. The method 500 also proceeds to part 522 in FIG. 5B where the results of the second drop detect test do not fail the criterion in part 514.

Where the threshold against which the counter is compared is three, this means that at most three different servicing events are performed in the various iterations of part 516. In the first iteration of part 516, the most-severe servicing event is performed. Performing the most-severe servicing event takes longer than performing less-severe servicing events. However, the likelihood that performing the most-severe servicing event will clear the clogged nozzles 404 of the inkjet printhead 402 is greater than if less-severe servicing events were instead performed. Thus, the likelihood that the second drop detect test (in the embodiment of FIG. 5A) will again fail is less after performing the most-severe servicing event than if a less-severe servicing event were performed first.

That is, what has been found in relation to pigment-based inks in particular is that performing servicing events in order from least-severe to most-severe during successive iterations still results in the most-severe servicing event more often than not having to be performed to clear the clogged inkjet nozzles 404. Therefore, while intuition would suggest that the least-severe servicing event be performed first, since it takes less time to complete such that servicing time may be minimized if performance of this servicing event yields cleared nozzles, it has been found in actuality that least-severe servicing event does not often clear the clogged inkjet nozzles 404 when performed first. Instead, performing the most-severe servicing event first, even though taking more time, is more likely to clear the clogged nozzles 404, so that less-severe servicing events do not have to be performed.

Referring next to FIG. 5B, the method 500 continues from part 514 or from part 520 by performing a sustainability purge operation (522). Performing a sustainability purge operation for the inkjet nozzles 404 of the inkjet printhead 402 adds extra assurance that the inkjet nozzles 404 will remain clear of clogs during subsequent printing, or image-formation, operations. That is, the sustainability purge operation purges additional ink from the inkjet nozzles 404, to ensure that the inkjet nozzles 404 can in a sustained manner eject ink properly.

In one embodiment, the sustainability purge operation is performed by performing parts 524 and 530. A first series of spit-wipe operations is performed (526). Such a series of spit-wipe operations includes performing one or more spit operations (526), substantially interleaved with performing one or more wipe operations (528). A spit operation ejects a predetermined amount of ink from the inkjet nozzles 404 by firing the inkjet nozzles 404 a number of times at high frequency. A wipe operation cleans the nozzles 404 by moving the nozzles 404 against a stationary wiper, or by moving a wiper against the nozzles 404 as they remain stationary. A second series of spit-wipe operations is performed (530) after the first series of spit-wipe operations is performed.

Figure 7:
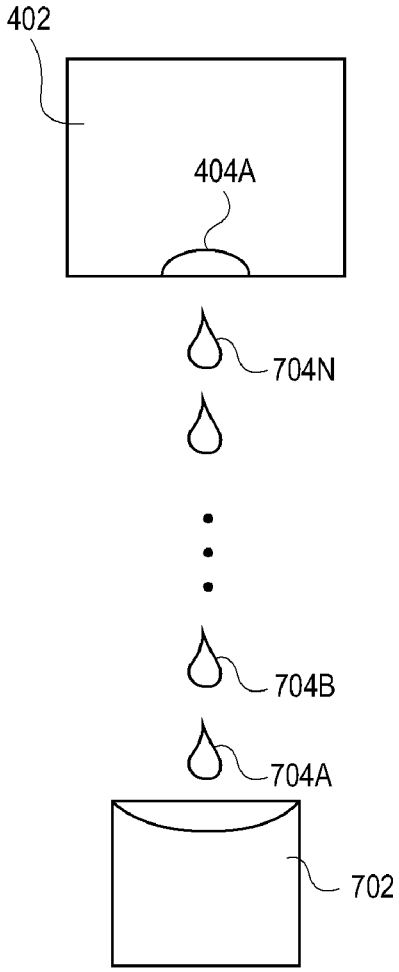
FIG. 7 is a diagram depicting a representative spit operation, according to an embodiment of the invention.

FIG. 7 illustratively shows a spit operation, according to an embodiment of the invention. Just a single inkjet nozzle 404A of the inkjet printhead 402 is depicted in FIG. 7 for illustrative clarity and convenience. The inkjet nozzle 404A is fired multiple times at a given frequency, such as twelve kilohertz, where each time the inkjet nozzle 404A is fired, desirably one of the ink droplets 704A, 704B, . . . , 704N, collectively referred to as the ink droplets 704, is ejected from the nozzle 404A. The total volume of the ink droplets 704 is the amount of ink ejected by the nozzle 404A during the spit operation. The ink droplets 704 are collected within a spittoon 702, and may later evaporate, or the spittoon 704 may be periodically emptied.

Figure 8:
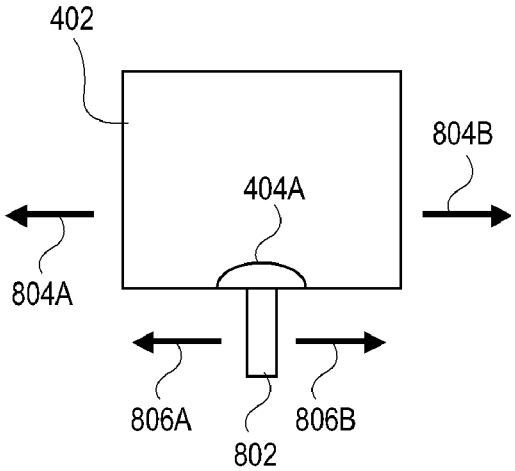
FIG. 8 is a diagram depicting a representative wipe operation, according to an embodiment of the invention.

FIG. 8 illustratively shows a wipe operation, according to an embodiment of the invention. Just a single inkjet nozzle 404A of the inkjet printhead 402 is depicted in FIG. 8 for illustrative clarity and convenience. In one embodiment, the inkjet printhead 402 is moved back and forth as indicated by arrows 804A and 804B so that the inkjet nozzle 404A is moved back and forth against a stationary wiper 802. The wiper 802 may be a polymer tab, or another type of wiper. In another embodiment, the inkjet printhead 402 remains stationary, and the wiper 802 is moved back and forth against the inkjet nozzle 404A, as indicated by arrows 806A and 806B.

Figure 9:
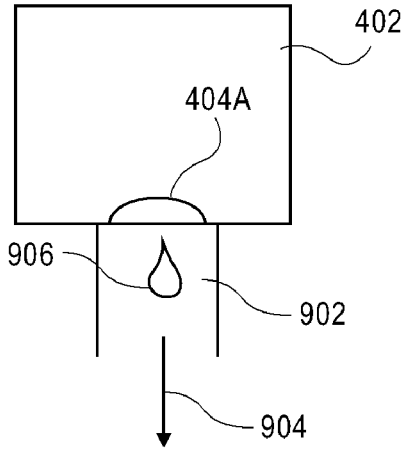
FIG. 9 is a diagram depicting a representative prime operation, according to an embodiment of the invention.

It is noted that in at least one embodiment, the sustainability purge operation of part 522 of FIG. 5B does not include performance of any prime operations, but just spit and wipe operations. However, FIG. 9 illustratively shows a prime operation, according to an embodiment of the invention. The prime operation depicted in FIG. 9 may be that which is performed as part of the servicing event that may be performed in at least some iterations of part 516. Just a single inkjet nozzle 404A of the inkjet printhead 402 is depicted in FIG. 9 for illustrative clarity and convenience. A cap, or primer, 902 seals around the inkjet nozzles, including the inkjet nozzle 404A. Negative air pressure around the inkjet nozzle 404A is then created by a suction or vacuum effect, as indicated by the arrow 904. As a result, ink, as denoted by the ink droplet 906, is removed from the inkjet nozzle 404A, and the area surrounding the inkjet nozzle 404A. A heavy servicing operation may create greater suction and/or apply suction for a longer period of time, than a light servicing operation.

Referring back to FIG. 5B, in one embodiment of the invention, each of the first and the second series of spit-wipe operations is a predetermined sequence of spit and wipe operations. One such sequence may include two sub-sequences. The first sub-sequence may include a first spit operation, followed by a second spit operation, a third spit operation, a wipe operation, and a fourth spit operation. The second sub-sequence may include a first spit operation, followed by a first wipe operation, a second spit operation, a third spit operation, a second wipe operation, and a fourth spit operation. The predetermined sequence may thus include performing one iteration of the first sub-sequence, followed by three iterations of the second sub-sequence. Each of the first and the second series of spit-wipe operations denoted in FIG. 5B may be this predetermined sequence of spit and wipe operations.

The performance of both spit and wipe operations in a sustainability purge of the inkjet nozzles 404 of the inkjet printhead 402 differs from the prior art, and is somewhat counterintuitive. Conventional sustainability purges, for instance, typically just involve a number of spit operations, since the motivation is to clear the inkjet nozzles as much as possible. However, what has been found is that such conventional sustainability purges can result in undesired sludge buildup on the inkjet nozzles 404 where pigment-based inks are used, resulting in later image formation or printing problems. Therefore, although performing one or more wipe operations is not intuitively performed during a purge operation, embodiments of the invention nevertheless perform such wipe operations to clean the sludge buildup on the inkjet nozzles 404 resulting from the spit operations.

After the sustainability purge operation has been performed, an alignment operation of the inkjet nozzles 404 of the inkjet printhead 402 may be performed (532). This operation is performed to align the ink droplets ejected by the nozzles 404 relative to one another, and as such adjusts the relative positioning of the ink droplets. Such an alignment operation may be performed as is conventional, as can be appreciated by those of ordinary skill within the art.

Likewise, a color calibration operation of the inkjet nozzles 404 of the inkjet printhead 402 may be performed (534). This operation is performed to ensure that the colors that are formed by ejecting differently colored of the inks match predetermined profiles or other criteria. This operation adjusts how much of each ink is ejected to ensure a given color results. Such a color calibration operation may be performed as is conventional, as can be appreciated by those of ordinary skill within the art. Finally, the most-severe servicing event is again performed (536), to potentially clear any of the nozzles 404 that may have been clogged, or that may soon clog when normal image formation or printing commences, as a result of the operations of parts 532 and 534.

Referring finally to FIG. 5C, another counter is reset (538). The first drop detect test is performed again (540), as is the second drop detect test (542). Where the results of the second drop detect test failed the criterion (544), then a servicing event corresponding to the current value of the counter is performed (546). In one embodiment, one of four servicing events, corresponding to counter values of zero, one, two, and three, is performed in part 546 of the method 500.

The first servicing event may include performing heavy prime, spit, and wipe operations. The second servicing event is less severe than the first servicing event, and may include performing light prime, spit, and wipe operations. The third servicing event is more severe than the first servicing event, and may include performing scrub, spit, and wipe operations. A scrub operation is similar to a wipe operation. However, where a wipe operation moves the wiper in relation to the printhead back and forth in smooth motions, a scrub operation moves the wiper in relation to the printhead back and forth in jerky motions. As such, a scrub operation may be considered a mechanically agitated wipe operation. The fourth servicing event is identical to the first servicing event. Thus, in part 546, unlike in part 516, the first servicing event performed is not the most-severe servicing event.

The counter is then incremented (548), and where the current value of the current is less then a predetermined threshold, such as four, the method 500 repeats at part 540 (550). Therefore, at most four servicing events are performed in various iterations of part 548, depending on whether the second drop detect test fails the criterion in part 544, which may, as before, be whether more than twenty of the inkjet nozzles 404 of the inkjet printhead 402 failed to eject ink. Where the second drop detect test satisfies the criterion in part 544, or once the counter has reached the predetermined threshold in part 550, the method 500 is finished (552). As such, the inkjet-printing device 100 is ready to form images on media by ejecting ink.

Concluding Block Diagram of Fluid-Ejection Device

Figure 10:
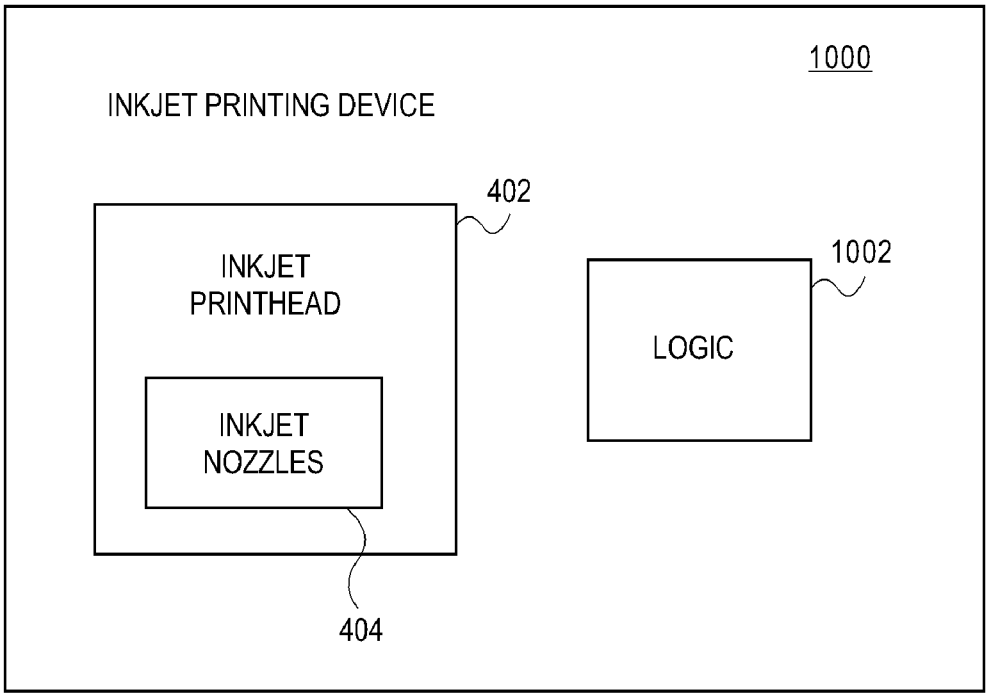
FIG. 10 is a rudimentary block diagram of an inkjet-printing device, according to an embodiment of the invention.

In conclusion, FIG. 10 shows a block diagram of the inkjet-printing device 100, according to an embodiment of the invention. As has been noted, the inkjet-printing device 100 is more generally a fluid-ejection device. The inkjet-printing device 100 is depicted in FIG. 10 as including the inkjet printhead 402 and logic 1002. As can be appreciated by those of ordinary skill within the art, the inkjet-printing device 100 may include other components, in addition to and/or in lieu of those depicted in FIG. 10. For example, the inkjet-printing device 100 may include the drop detector 602 of FIG. 6 that has been described, as well as various motors, carriages, and so on, to properly move the inkjet printhead 402 and/or the media on which the printhead 402 forms an image.

The inkjet printhead 402 is depicted as part of the inkjet-printing device 100 in FIG. 10 to denote that the inkjet-printing device 100 can include one or more of the inkjet printheads 302 that have been described. The inkjet printhead 402 is more generally an inkjet-printing mechanism, and is most generally a fluid-ejection mechanism. The inkjet printhead 402 includes a number of inkjet nozzles 404 from which ink is actually ejected. The inkjet nozzles 404 are more generally fluid-ejection nozzles that eject fluid, such as dye-based ink, pigment-based ink, or another type of ink.

The logic 1002 may be implemented in software, hardware, or a combination of software and hardware, and may be considered the means that performs various functionality. The logic 1002 can perform, or cause the inkjet printhead 402 to perform, the method 500 of FIGS. 5A, 5B, and 5C that has been described. Thus, the logic 1002 can cause the inkjet printhead 402 to perform more than one drop detect tests before determining whether to service the inkjet printhead 402 so that ink is properly ejected.

As another example, the logic 1002 can cause the inkjet printhead 402 to be serviced by performing one or more servicing events, where the most-severe servicing event is performed first, as has been described. As a final example, the logic 1002 can cause ink to be purged from the inkjet nozzles 404 by performing a number of series of spit-wipe operations, where both spit operations and wipe operations are performed. Thus, the logic 1002 can determine whether servicing has to be performed, and cause such servicing to be performed if needed.

We claim:

1. A method comprising:

consecutively performing a plurality of drop detect tests to determine whether a fluid-ejection mechanism having a plurality of fluid-ejection nozzles is properly ejecting fluid, without performing any servicing event for the fluid-ejection mechanism in-between consecutive of the drop detect tests;

in response to results of a last drop detect test having failed a criterion, performing a servicing event to cause the fluid-ejection mechanism to properly eject the fluid, the servicing event performed corresponding to a value of a counter, where a severity of the servicing event decreases with an increase in the value of the counter such that a most severe servicing event is performed first, where the most severe servicing event ejects more of the fluid than less severe servicing events;

incrementing the counter, wherein just the results of the last drop detect test are used as a basis upon which to decide whether to perform the servicing event, such that results of the drop detect tests other than the last drop detect test are not used as a basis upon which to decide whether to perform the servicing event.

2. The method of claim 1, further comprising, in response to the results of the last drop detect test not having failed the criterion, performing a purge operation to purge fluid from the fluid-ejection nozzles.

3. The method of claim 2, wherein performing the purge operation comprises one or more of:

performing a first series of spit-wipe operations; and, performing a second series of spit-wipe operations.

4. The method of claim 3, wherein performing each of the first and the second series of spit-wipe operations comprises performing a number of spit operations and performing a number of wipe operations.

5. The method of claim 4, wherein performing each spit operation comprises ejecting a predetermined amount of the fluid from each fluid-ejection nozzle.

6. The method of claim 4, wherein performing each wipe operation comprises wiping each fluid-ejection nozzle.

7. The method of claim 6, wherein wiping each fluid-ejection nozzle of the fluid-ejection mechanism comprises one of:

moving the fluid-ejection nozzle against a stationary wiper; and, moving a wiper against the fluid-ejection nozzle while the fluid-ejection nozzle remains stationary.

8. The method of claim 3, wherein performing the first series of spit-wipe operations comprises performing a first sub-sequence of spit-wipe operations including, in order, a first spit operation, a second spit operation, a third spit operation, a wipe operation, and a fourth spit operation.

9. The method of claim 8, wherein performing the first series of spit-wipe operations further comprises performing, after the first sub-sequence, a second sub-sequence of spit-wipe operations including, in order, a first spit operation, a first wipe operation, a second spit operation, a third spit operation, a second wipe operation, and a fourth spit operation.

10. The method of claim 9, wherein performing the first series of spit-wipe operations further comprises repeating the second sub-sequence of spit-wipe operations one or more times.

11. The method of claim 10, wherein the second sub-sequence is performed a total of three times.

12. The method of claim 3, wherein both the first series of spit-wipe operations and the second series of spit-wipe operations are both performed.

13. The method of claim 3, wherein the second series of spit-wipe operations is identical to the first series of spit-wipe operations.

14. A method comprising:

consecutively performing a plurality of drop detect tests to determine whether a fluid-ejection mechanism having a plurality of fluid-ejection nozzles is properly ejecting fluid, without performing any servicing event for the fluid-ejection mechanism in-between consecutive of the drop detect tests; and, in response to results of the last drop detect test not having failed the criterion, performing a purge operation to purge fluid from the fluid-ejection nozzles, wherein just the results of the last drop detect are used as a basis upon which to decide whether to perform the purge operation, such that results of the drop detect tests other than the last drop detect test are not used as a basis upon which to decide whether to perform the purge operation.

15. The method of claim 14, wherein performing the purge operation comprises one or more of:

performing a first series of spit-wipe operations; and, performing a second series of spit-wipe operations.

16. The method of claim 15, wherein performing each of the first and the second series of spit-wipe operations comprises performing a number of spit operations and performing a number of wipe operations.

17. The method of claim 15, wherein both the first series of spit-wipe operations and the second series of spit-wipe operations are both performed.

18. The method of claim 15, wherein the second series of spit-wipe operations is identical to the first series of spit-wipe operations.

19. An inkjet printing device comprising:

an inkjet printing mechanism having a plurality of inkjet nozzles; and, logic to:

consecutively perform a plurality of drop detect tests to determine whether the fluid-ejection mechanism is properly ejecting fluid, without performing any servicing event for the fluid-ejection mechanism in-between consecutive of the drop detect tests;

in response to results of a last drop detect test having failed a criterion, perform a servicing event to cause the fluid-ejection mechanism to properly eject the fluid, the servicing event performed corresponding to a value of a counter, where a severity of the servicing event decreases with an increase in the value of the counter such that a most severe servicing event is performed first, where the most severe servicing event ejects more of the fluid than less severe servicing events;

increment the counter, wherein just the results of the last drop detect are used as a basis upon which to decide whether to perform the servicing, event such that results of the drop detect tests other than the last drop detect test are not used as a basis upon which to decide whether to perform the servicing event.

20. The inkjet printing device of claim 19, wherein the logic is further to, in response to the results of the last drop detect test not having failed the criterion, perform a purge operation to purge fluid from the fluid-ejection nozzles.

* * * * *